US011352791B1

(12) United States Patent
Nicholls

(10) Patent No.: US 11,352,791 B1
(45) Date of Patent: Jun. 7, 2022

(54) REBAR COVER

(71) Applicant: Joseph H. Nicholls, Makawao, HI (US)

(72) Inventor: Joseph H. Nicholls, Makawao, HI (US)

( * ) Notice: Subject to any disclaimer, the term of this patent is extended or adjusted under 35 U.S.C. 154(b) by 0 days.

(21) Appl. No.: 17/225,847

(22) Filed: Apr. 8, 2021

(51) Int. Cl.
*E04C 5/16* (2006.01)
*E04G 21/32* (2006.01)
*B65D 63/10* (2006.01)

(52) U.S. Cl.
CPC ..... *E04C 5/161* (2013.01); *B65D 63/1072* (2013.01); *E04G 21/3252* (2013.01)

(58) Field of Classification Search
CPC ..... E04C 5/161; F16L 57/005; E04G 21/3252
See application file for complete search history.

(56) References Cited

U.S. PATENT DOCUMENTS 5,363,618 A * 11/1994 Underwood ..... E04C 5/02 52/301
5,487,618 A * 1/1996 Cox ..... E01F 15/0469 256/13.1
5,600,927 A 2/1997 Kennon
5,687,772 A 11/1997 Underwood
6,073,415 A 6/2000 Carnicle
6,085,478 A 7/2000 Workman
6,138,327 A * 10/2000 Powell ..... B29C 45/14467 24/16 PB
7,472,522 B2 1/2009 Yang
7,716,898 B1 5/2010 Dunn
8,479,361 B2 * 7/2013 Every ..... B65D 63/1063 24/16 PB
10,065,777 B2 * 9/2018 King ..... F16L 3/2334
10,336,519 B2 7/2019 King
10,689,173 B2 6/2020 King
2012/0017401 A1 * 1/2012 Cheng ..... B65D 63/1072 24/16 R
2012/0272485 A1 * 11/2012 Liang ..... B65D 63/1063 24/16 PB
2014/0165339 A1 * 6/2014 Yuan ..... B65D 63/1072 24/16 PB
2015/0247323 A1 9/2015 Kassarjian
2018/0298613 A1 10/2018 Eversberg
2019/0168937 A1 * 6/2019 McDowell, III ... B65D 63/1072

FOREIGN PATENT DOCUMENTS

AU 2016266111 12/2016
EP 1840292 3/2007
JP 4162172 10/2008
KR 101145760 5/2012
KR 20160014092 2/2016
WO WO 2005071276 8/2005

* cited by examiner

*Primary Examiner* — Adriana Figueroa
(74) *Attorney, Agent, or Firm* — Ray Quinney & Nebeker; Thomas L. Lingard

(57) ABSTRACT

A rebar cover includes a shaft having a first end and a bottom end with a central bore therethrough. A bar tie is extended into the central bore through one or more openings in a sidewall of the shaft. When inserted into the central bore, a looped portion of the bar tie may loop around the rebar. The bar tie includes a ratcheting mechanism to secure the rebar to the rebar cover. The ratcheting mechanism includes a release lever to place the ratcheting mechanism in an open position, thereby allowing the bar tie to be loosened and the rebar cover removed from the rebar.

20 Claims, 7 Drawing Sheets

REBAR COVER

CROSS-REFERENCE TO RELATED APPLICATIONS

N/A.

BACKGROUND

Modern structures typically include metal bars used for reinforcing concrete, securing structural steel, securing machinery, many other purposes, and combinations thereof. During construction, such metal bars may extend from the ground or from a slab of concrete. To prevent injuries related to the metal bars, a cover may be placed over the exposed end of the metal bar.

Typical covers include a cylindrical shaft covered by a top plate. The metal bar may extend into the cylindrical shaft, thereby reducing the chance of injury caused by a worker or other person scraping or impaling him or herself on the metal bar. Typically, the cover is fabricated from a brightly colored plastic, or painted a bright color, to increase visibility. Conventional covers include one or more "fins," or thin plates extending radially into the center of the shaft. The fins are supposed to grip the metal bar and prevent the cover from being easily dislodged. However, such fins are easily broken over several uses. Covers with broken fins are easily dislodged from the end of the metal bar, thereby exposing the end to workers or other people around the metal bar.

BRIEF SUMMARY

In some embodiments, a rebar cover includes a shaft having a first end, a second end opposite the first end, and a central bore extending between the first end and the second end. A sidewall includes a first opening and a second opening through the sidewall into the central bore. A cover plate covers the top end of the shaft. A bar tie is at least partially located in the central bore. The bar tie includes a head having a ratcheting mechanism. A flexible body extends into the central bore through the first opening and out of the central bore through the second opening. The ratcheting mechanism prevents the flexible body from being removed from the head in a second direction opposite the first direction. In some embodiments, the ratcheting mechanism includes a release leaver that opens the ratcheting mechanism to allow the flexible body to be removed from the head in the second direction.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 3-1 and FIG. 3-2 are representations of a bar tie, according to at least one embodiment of the present disclosure;

DETAILED DESCRIPTION

Figure 1:
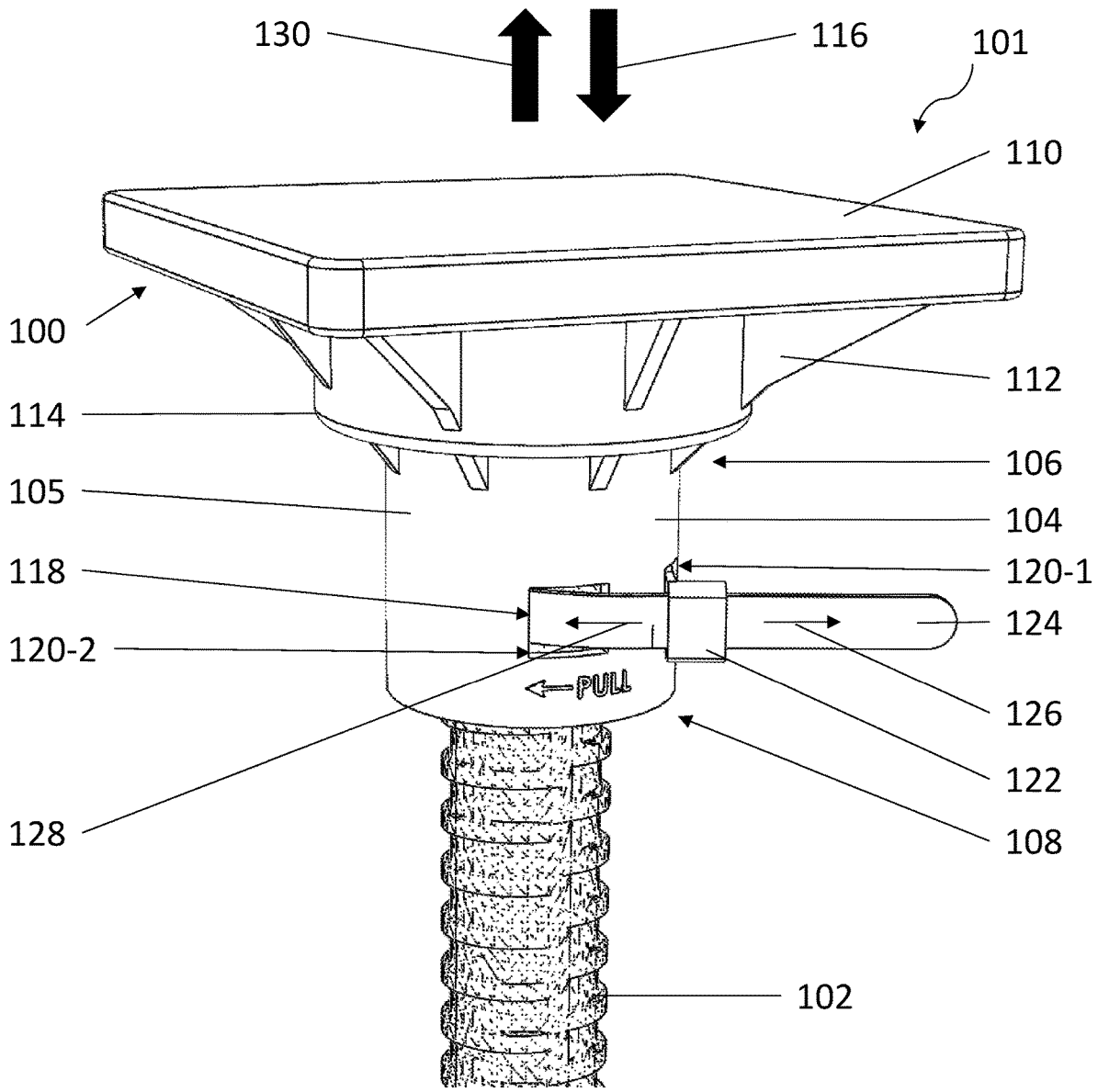
FIG. 1 is a representation of a perspective view of a rebar cover assembly, according to at least one embodiment of the present disclosure.

This disclosure generally relates to devices, systems, and methods for a rebar cover that maintains position on a piece of rebar for multiple uses. The rebar cover may include a ratcheting bar tie inserted into a central bore of a shaft of the rebar cover. When an exposed end of a piece of rebar is extended into the central bore, the ratcheting bar tie may be tightened around the exposed end of the rebar. This may secure the cover to the exposed end of the rebar, thereby reducing or preventing accidental or unintentional removal of the rebar cover from the exposed end of the rebar. To remove the rebar cover, a worker may press a release lever. The release lever may allow the ratcheting bar tie to be loosened around the end of the rebar. The rebar cover may then be removed and reused multiple times. In this manner, the rebar covers discussed here may be reusable, thereby reducing material costs associated with replacing conventional rebar covers.

The present disclosure includes a number of practical applications that provide benefits and/or solve problems associated with rebar and other metal bar covers. For example, as will be discussed in further detail herein, systems described herein disclose the use of a release lever to allow for quick and easy release of the bar tie. Quickly and easily removing the bar tie may facilitate multiple uses of the same rebar cover without significant loss of function of the rebar cover.

In some circumstances, rebar covers may be used on every piece of protruding rebar or other elongate bar at a particular construction site. In some situations, governmental entities, such as the Occupational Safety and Health Administration (OSHA) may require the use of a rebar cover over any piece of protruding rebar, or over any piece of protruding rebar that may represent a hazard to a worker. Construction supervisors under the jurisdiction of such a governmental entity often spend significant amounts of time and resources placing dislodges rebar covers back on a piece of rebar and/or purchasing new rebar covers to cover defective ones. Rebar covers in accordance with the present disclosure may allow an operator to install a single rebar cover on a piece of rebar that remains secured to the rebar even when bumped, jostled, or otherwise moved. In this manner, the construction operator may remain in compliance with governmental regulations.

In another example, as will be discussed further herein, the use of a ratcheting bar tie may allow for a secure connection between the rebar and the rebar cover. A worker may pull the ratcheting bar tie as tight as desired. The ratcheting mechanism may help to prevent the ratcheting bar tie from unintentionally loosening from the rebar. Rebar covers are often dislodged or removed from the exposed end of a piece of rebar during normal construction or other activities, such as through direct contact of the rebar cover with people and/or equipment, contact with the rebar that disturbs the rebar cover, contact with the concrete or other structure to which the rebar is connected, and so forth. Dislodged or removed rebar covers may become damaged (during removal and/or by trampling or running over of equipment and people) and/or may take valuable time to replace. When tightened, the ratcheting bar ties disclosed herein may increase the removal force of the rebar cover, thereby reducing or preventing accidental or unintentional removal of the rebar cover. This may save workers time by reducing the number of rebar covers to be replaced. Furthermore, this may reduce the number of rebar covers broken when they have fallen off, thereby reducing replacement costs.

In accordance with embodiments of the present disclosure, a looped portion of the ratcheting bar tie may be located within the central bore of the shaft of the rebar cover. The looped portion may connect to the rebar cover within the central bore of the shaft. This may help to prevent the ratcheting bar tie from slipping on the rebar, thereby improving the strength and the reliability of the connection between the rebar cover and the rebar.

FIG. 1 is a representation of a rebar cover assembly 101 having a rebar cover inserted on the exposed end of a piece of rebar 102, according to at least one embodiment of the present disclosure. The rebar cover includes a shaft 104 having a central bore extending therethrough. The shaft 104 includes a first end 106 and a second end 108, opposite the first end. A sidewall 105 extends between the first end 106 and the second end 108. A cover plate 110 may be located at and cover the first end 106. The cover plate 110 may cover the central bore of the shaft 104, thereby preventing the shaft 104 from traveling down the rebar 102. The cover plate 110 may have a larger surface area than the rebar 102 to spread out forces applied to the rebar cover assembly 101. This may help to reduce and/or prevent injury to a worker or other person by the exposed end of the rebar 102.

It should be understood that, in accordance with embodiments of the present disclosure, "rebar" may be any elongate bar having an exposed end. Such bars may include reinforcing bar (e.g., rebar), which may be embedded in concrete to increase the structural properties of the concrete. However, such bars may also include any other elongate bar having an exposed end, such as cylindrical steel, structural steel, threaded rods, connector rods, wooden stakes, fence posts, any other elongate bar, and combinations thereof. Furthermore, as may be seen, elongate bars may be formed out of any material, including metal, plastic, wood, any other material, and combinations thereof.

In the embodiment shown, the cover plate 110 has a square shape. However, it should be understood that the cover plate 110 may have any other shape, including circular, triangular, rectangular, pentagonal, hexagonal, heptagonal, octagonal, nonagonal, polygonal of any number of sides, non-polygonal, any other shape, and combinations thereof. In the embodiment shown, the cover plate 110 is connected to the shaft 104 with a plurality of plate braces 112. The plate braces 112 may provide structural integrity for off-center forces applied to the top of the cover plate 110. The cover plate 110 may further include a metal plate 114 that is configured to come into contact with the end of the piece of rebar 102. The metal plate 114 may help to prevent the rebar 102 from punching through the cover plate 110 when a downward force 116 (e.g., parallel to a longitudinal or long axis of the rebar 102) is applied to the rebar cover 100.

The rebar cover 100 may further include retention mechanism, such as a bar tie 118. In some embodiments, one or more openings (collectively 120) may extend through the sidewall 105 of the shaft and into the central bore. The bar tie 118 may be at least partially inserted into the central bore of the shaft 104 through a first openings 120-1 and extend out of the central bore through a second opening 120-2. The bar tie 118 includes a head 122. A flexible body 124 of the bar tie 118 may be looped around the rebar 102 inside the central bore of the shaft 104. The flexible body 124 may be inserted into the head 122. The head 122 may include a ratcheting mechanism that allows the flexible body 124 to be inserted into the head 122 and tightened, but not removed and loosened. Put another way, the ratcheting mechanism may allow the flexible body 124 to be inserted into the head 122 and moved in the first direction 126 (e.g., the tightening direction). However, the ratcheting mechanism may prevent the flexible body 124 from being removed from the head 122 and moved in the second direction 128.

When the bar tie 118 is tightened, the bar tie 118 may apply a compressive force to the rebar 102. The compressive force applied to the rebar 102 may pull the rebar toward the inner wall of the shaft 104. Friction between the bar tie 118 and the rebar 102 and/or the inner wall of the shaft 104 and the rebar 102 may prevent the rebar cover 100 from being removed when an upward force 130 is applied to the rebar cover 100 (e.g., a force parallel to the longitudinal axis or the long axis of the rebar 102 and opposite or approximately opposite the downward force 116). While the upward force 130 is shown as being parallel to the longitudinal axis of the rebar 102, it should be understood that the upward force 130 may be a component of another force. For example, a force transverse to the longitudinal axis of the rebar 102 may be applied to the rebar cover 100, and that transverse force may include a component in the direction of the upward force 130 However, for ease of illustration, only the upward force 130 has been illustrated in FIG. 1. In this manner, as the rebar 102 and/or the rebar cover 100 are bumped, jostled, or otherwise experience upward forces 130, the rebar cover 100 may remain secured to the end of the rebar 102.

Conventionally, a rebar cover includes one or more stabilizer fins in the bore of a shaft. These stabilizer fins may apply a gripping force on the rebar 102. However, when installing a conventional rebar cover, a significant downward forces is used to jam the rebar 102 between the stabilizer fins. This results in a removal force that is equal to or less than (due to damage) the installation force. Furthermore, the installation of conventional rebar covers may damage the stabilizer fins, reducing the gripping capacity of the fins. Every bump, jostle, and movement the conventional the rebar cover experiences may reduce the connection of the rebar cover to the rebar. This may reduce the gripping strength of the fins until the fins no longer provide any grip to the rebar 102.

In accordance with embodiments of the present disclosure, the rebar 102 may be inserted into the shaft 104 while the bar tie 118 is loose. Thus, there is a very low installation force. A significant removal force is not present until the bar tie 118 is tightened. The removal force caused by the grip of the bar tie 118 to the rebar 102 is significantly higher than the installation force. Furthermore, the removal force may be tailored to the situation, based on how tightly the bar tie 118 is tightened. The ratcheting mechanism in the head 122 may prevent the bar tie 118 from loosening, even after experiencing bumps, jostles, or other movement. In this manner, the rebar cover 100 is securely connected to the rebar 102, and may only be removed by breaking the bar tie 118 and/or the shaft 104.

Figure 2:
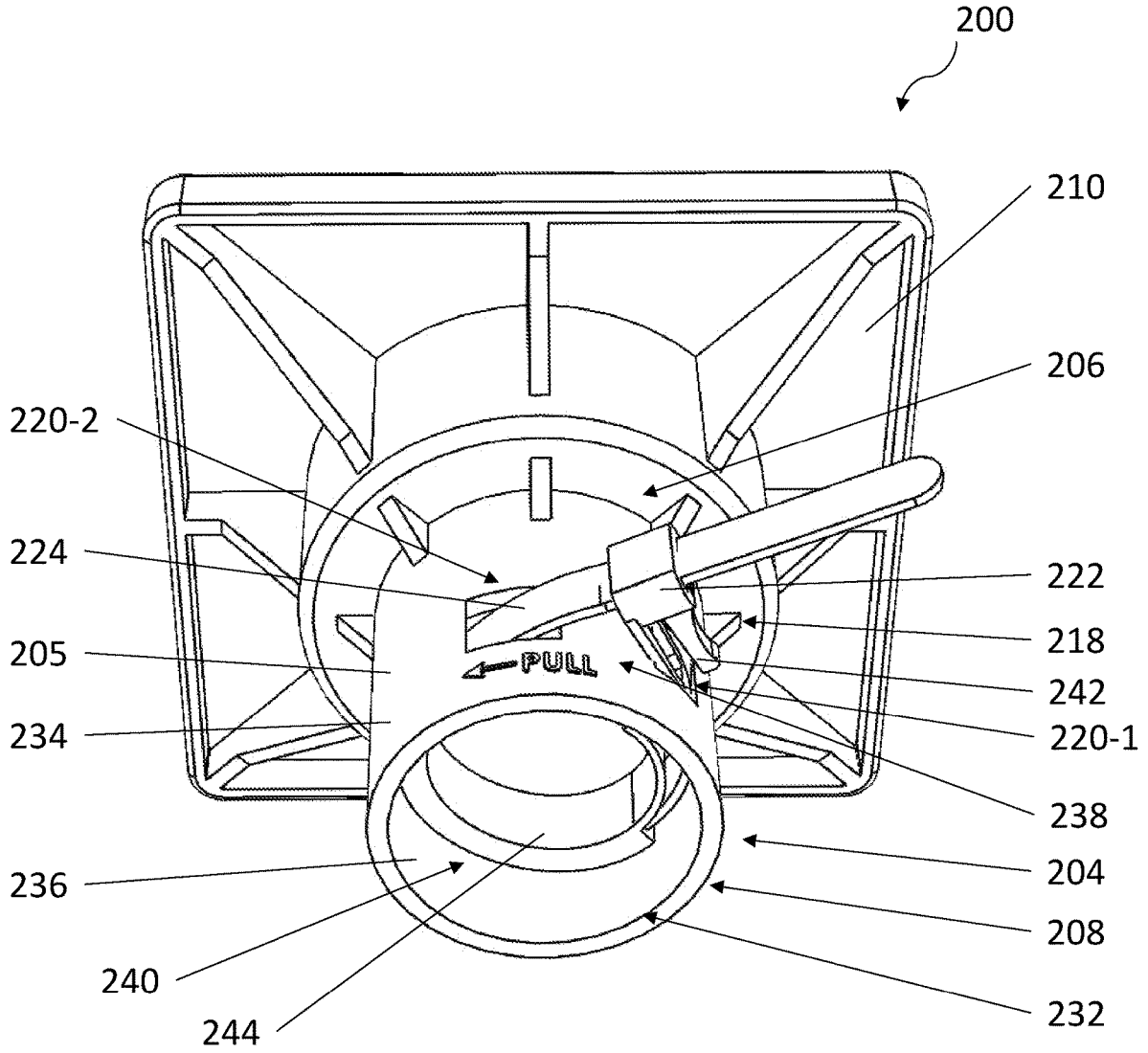
FIG. 2 is a representation of a perspective view of a rebar cover, according to at least one embodiment of the present disclosure.

FIG. 2 is a representation of a perspective view of a rebar cover 200, according to at least one embodiment of the present disclosure. The rebar cover 200 shown includes a shaft 204 having a first end 206 and a second end 208, opposite the first end 206. A sidewall 205 extends between the first end 206 and the second end 208. A cover plate 210 may be located at and cover the first end 206. The shaft 204 may be hollow, with the sidewall 205 defining central bore 232 that extends through the shaft 204 from the first end 206 to the second end 208. The sidewall 205 includes an outer surface 234 and an inner surface 236.

A first opening 220-1 and a second opening 220-2 extend through the sidewall 205 from the outer surface 234 to the inner surface 236 and into the central bore 232. In the embodiment shown, the first opening 220-1 and the second opening 220-2 are circumferentially aligned. Put another way, the first opening 220-1 and the second opening 220-2 are the same distance from the second end 208 of the shaft 204. In some embodiments, the first opening 220-1 and the second opening 220-2 may not be circumferentially aligned. In some embodiments, the first opening 220-1 and the second opening 220-2 may be separated by a tie support 238.

A bar tie 218 is inserted into the central bore 232. The bar tie 218 includes a head 222 and a flexible body 224. In some embodiments, the flexible body 224 may be elastically deformable such that, upon bending the flexible body 224, the flexible body may return to its original shape. In some embodiments, the flexible body 224 may be plastically deformable. The flexible body 224 may be inserted into the central bore 232 through the first opening 220-1 and may extend out of the central bore through the second opening 220-2, creating a looped portion 240 of the bar tie 218 inside the central bore 232. The head 222 may remain outside of the shaft 204. When the flexible body 224 is inserted through the head 222, the bar tie 218 may be secured to the rebar cover 200 by the tie support 238. Put another way, the bar tie 218 may be looped around the tie support 238 and the tie support 238 may prevent the bar tie 218 from being removed without breaking the bar tie 218 and/or the tie support 238. When tightened, the head 222 may be supported and/or contact the tie support 238.

As the flexible body 224 is pulled through the head 222, the looped portion 240 may become smaller (e.g., decrease in radius/diameter). To install the rebar cover 200 on an exposed end of rebar, the looped portion 240 may be enlarged so that the flexible body 224 is contacting the inner surface 236 of the shaft 204 (e.g., the flexible body 224 may be pushed through the head 222). The end of the rebar may be inserted into the central bore 232 and through the looped portion 240. When the looped portion 240 surrounds the rebar, the bar tie 218 may be pulled tight around the rebar. Put another way, the diameter of the looped portion 240 may be reduced until the flexible body 224 is in contact with the rebar. This may pull the rebar into contact with the inner surface 236 of the shaft 204 such that the rebar is compressed between the looped portion 240 of the bar tie 218 and the shaft. As may be seen, the rebar cover 200 may therefore be secured to a variety of rebar diameters. For example, the rebar cover 200 may be secured to #1 rebar (0.125 in., 3.2 mm), #2 rebar (0.25 in., 6.4 mm), #3 rebar (0.375 in., 9.5 mm), #4 rebar (0.50 in., 1.3 cm), #5 rebar (0.625 in., 1.6 cm), #6 rebar (0.75 in., 1.9 cm), #7 rebar (0.875 in., 2.2 cm), #8 rebar (1.0 in., 2.5 cm), #9 rebar (1.125 in., 2.9 cm), #10 rebar (1.25 in., 3.2 cm), #11 rebar (1.375 in., 3.5 cm), #12 rebar (1.50 in., 3.8 cm), or any value therebetween. However, it should be understood, that the rebar cover 200 may be secured to any size diameter of elongate bar, including smaller than 0.125 in. (3.2 mm) or larger than 1.50 in. (2.8 cm).

The bar tie 218 may include a ratcheting mechanism. The ratcheting mechanism may be configured to allow the bar tie 218 to be tightened (e.g., to reduce the diameter of the looped portion 240), but prevent the bar tie 218 from being loosened (e.g., increase the diameter of the looped portion 240). For example, the ratcheting mechanism may prevent the bar tie 218 from being loosened without plastically deforming or fracturing at least a portion of the ratcheting mechanism and/or the flexible body.

In some embodiments, the ratcheting mechanism may include a release lever 242. The release lever 242 may be configured to move the ratcheting mechanism between an open and a closed configuration. In the closed configuration, the ratcheting mechanism may allow the bar tie 218 to be tightened but may prevent the bar tie 218 from being loosened. In the open configuration, the ratcheting mechanism may allow the bar tie to be loosened without plastically deforming and/or fracturing the ratcheting mechanism and/or the flexible body 224. The release lever 242 may be large. For example, the release lever 242 may be large enough for a worker to find and depress the release lever 242 while wearing gloves, such as protective work gloves. In this manner, the release lever 242 may allow for the rebar cover 200 to be easily removable. By placing the ratcheting mechanism back in the closed configuration with the release lever 242, the rebar cover 200 may be reused multiple times. This reusability may help to provide cost savings for the operator or the construction manager by reducing the number of new rebar covers purchased for a given project.

In some embodiments, the bar tie 218 may be selectively removable from the rebar cover 200. To remove the bar tie, the release lever 242 may be depressed and the flexible body 224 pulled out of the head 222. In this manner, if any portion of the bar tie 218 is damaged, worn out, broken, or otherwise inoperable, the worn out bar tie 218 may be replaced with a new bar tie 218. This may help to extend the serviceable life of the rebar cover 200. In some embodiments, the bar tie 218 may be separately formed from the shaft 204. In some embodiments, the bar tie 218 may only be connected to the shaft 204 by the looped portion 240 and the tie support 238.

In the embodiment shown, the central bore 232 of the shaft 204 does not include any retention fins. Thus, the only retention force on the rebar cover 200 is applied by the bar tie 218. However, it should be understood that the rebar cover 200 may include one or more retention fins inside the bar tie 218.

The bar tie 218 secures the rebar to the shaft 204 using a friction force applied by the compressive force between the looped portion 240 and the inner surface 236 of the shaft. To increase the friction force applied to the rebar, at least part of the flexible body 224 may include a high friction coating 244. The high friction coating 244 may increase the coefficient of friction between the flexible body 224 and the rebar. This may increase the removal force of the rebar cover 200, thereby improving its retention on the rebar. In some embodiments, the inner surface 236 of the shaft 204 may be coated with the high friction coating 244. In some embodiments, the high friction coating 244 may be formed from silicone. In some embodiments, the high friction coating 244 may be formed from a thermoplastic elastomer (TPE). In some embodiments, the high friction coating 244 may be formed from any high friction element, including, but not limited to, neoprene, ethylene propylene diene monomer (EPDM), nitrile, any other high friction material, and combinations thereof.

In some embodiments, the high friction coating 244 may applied directly to the flexible body 224. In some embodiments, the high friction coating 244 may be a sleeve or attachment and separately connected to the flexible body 224. For example, the high friction coating 244 may include a sleeve having a slot into which the flexible body 224 may be inserted. This may allow an operator to replace the sleeve without replacing the entire bar tie 218. In some embodiments, the high friction coating 244 may be applied to the entire flexible body 224. In some embodiments, the high friction coating 244 may only be applied to the looped portion 240 such that the high friction coating 244 does not extend into or through the head 222.

In some embodiments, when the bar tie 218 is tightened against the rebar, the entire looped portion 240 may be located within the central bore 232 of the shaft 204. This may help to improve the connection of the rebar cover 200 to the rebar. In some embodiments, when the bar tie 218 is tightened against the rebar, the looped portion 240 may be oriented parallel or approximately parallel to the base surface at the second end 208. This may further help to strengthen the connection of the rebar cover 200 to the rebar. For example, orienting the looped portion 240 parallel or approximately parallel to the base surface may reduce the chance for the rebar to become dislodged or for the connection of the looped portion 240 to be loosened due to movement of the looped portion 240 relative to the rebar.

Figures 1, 3:
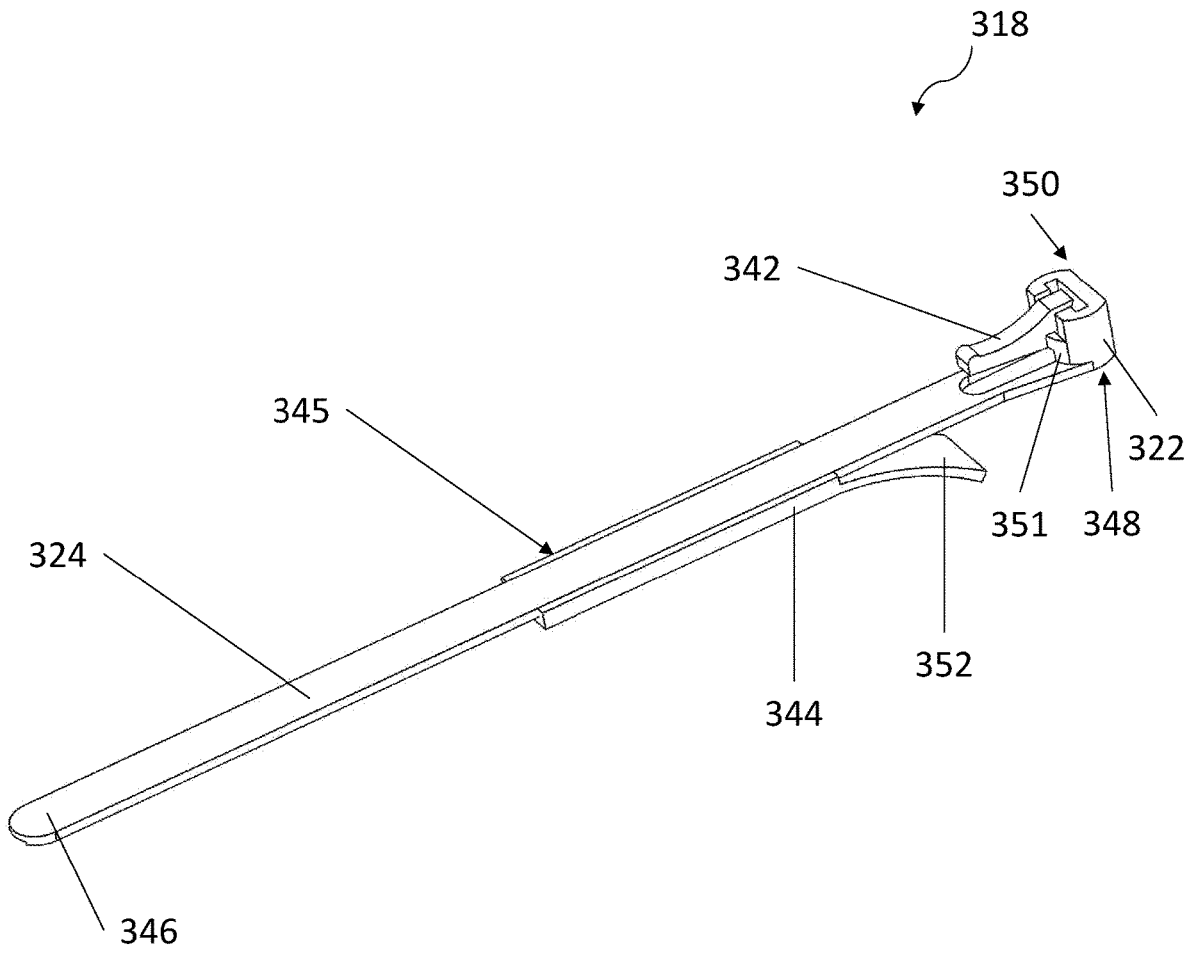
Figures 2, 3:
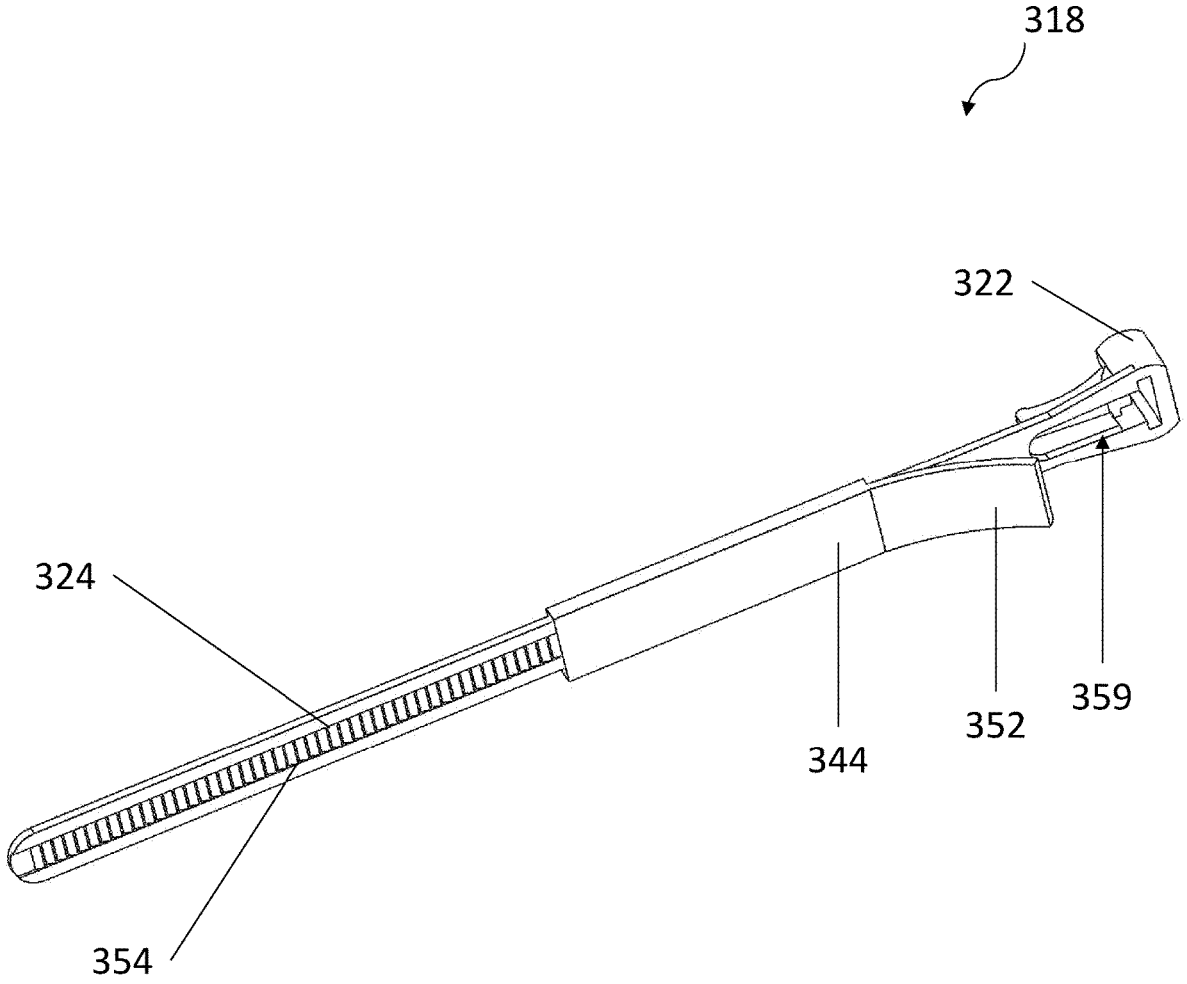

FIG. 3-1 is a representation of a top perspective view of a bar tie 318, according to at least one embodiment of the present disclosure. The bar tie 318 shown includes a head 322 and a flexible body 324. The flexible body 324 may be movable relative to the head 322. In some embodiments, to secure an end of a piece of rebar to a rebar cover, the flexible body 324 may be ben such that an insertion end 346 may be inserted into the head 322 at a bottom end 348 of the end. The insertion end 346 may pass through the head 322 and out of the top end 350.

The head 322 may include a ratcheting mechanism inside the head 322. The ratcheting mechanism may help to prevent the flexible body 324 from being removed from the head 322. The ratcheting mechanism may include a release lever 342. The release lever 342 may switch the ratcheting mechanism between a closed and an open position. In the closed position, the ratcheting mechanism may prevent the flexible body 324 from being removed from the head 322. In the open position, the ratcheting mechanism may not prevent the flexible body 324 from being removed.

The bar tie 318 shown includes a high friction coating 344 on an underside of the flexible body 324. When the bar tie 318 is formed into a loop (e.g., when the insertion end 346 is inserted into the head 322), the high friction coating 344 may be located on an inner surface of the looped flexible body. In the embodiment shown, the high friction coating 344 is a clip that is added to the underside of the flexible body 324. The high friction coating 344 may include a disconnected portion 352. The disconnected portion 352 may not be connected to the flexible body 324 to allow for a greater range of diameters connectable to the rebar.

FIG. 3-2 is a representation of a bottom perspective view of the bar tie 318 of FIG. 3-1. In the view shown, the underside of the flexible body includes a plurality of ridges 354. When the flexible body 324 is inserted into the head 322, the ridges 354 may engage with the ratcheting mechanism. The ratcheting mechanism may engage with the ridges 354 to help prevent the flexible body 324 from being removed from the head 322.

As may be seen, the high friction coating 344 is connected to the underside of the flexible body 324. This may cover up one or more of the ridges 354. In this manner, the high friction coating 344 may prevent the ridges 354 from being inserted into the head 322 and/or prevent the flexible body 324 from being inserted into the head past the high friction coating 344. The high friction coating 344 may only cover a portion of the flexible body 324. To allow the flexible body 324 to be inserted into the head 322, the high friction coating 344 may not cover an insertion section of the flexible body. Furthermore, the high friction coating 344 may include a disconnected portion 352. The disconnected portion may 352 not be connected to the flexible body 324. The disconnected portion 352 extend from the high friction coating 344. This may allow for more of the flexible body 324 to be inserted through the head 322. In some embodiments, the high friction coating 344 may cover an entirety of the flexible body. In some embodiments, the high friction coating 344 may be applied to the ridges 354 such that the ridges may be inserted through the head 322.

In the embodiment shown, the high friction coating 344 includes a slot 345. To attach the high friction coating 344 to the bar tie 318, the flexible body 324 may be inserted into the slot 345 such that the high friction coating 344 grips the flexible body 324 around the lateral edges of the flexible body 324. In the embodiment shown, the slot 345 is open such that the flexible body 324 may be inserted into the slot 345 perpendicularly to the length of the flexible body 324. In some embodiments, the slot 345 may be closed over the top such that the flexible body 324 is inserted through the slot 345 longitudinally, or along a length of the flexible body 324. In this manner, the high friction coating 344 may cover all four faces (e.g., the inside face having the ridges, as seen in FIG. 3-2, the outside face opposite the inside face, as seen in FIG. 3-1, and the two side faces that extend between the inside face and the outside face) of the flexible body. Thus, the high friction coating 344 may cover both the inside face and the outside face of the flexible body 324.

In the embodiment shown, the head 322 includes a lever cut-out 359. The lever cut-out 359 may be a space in the head 322 that allows the release lever 342 to be depressed further. This may help to ensure that a worker may depress the release lever 342 sufficiently to move the wedge out of the valley between two ridges. In some embodiments, the release leaver 342 may extend out from the head 322 so that the body of the release lever 342 extends parallel or approximately parallel to the flexible body 324. When a worker depresses the release lever 342, the release lever 342 may be pushed toward the flexible body 324 and into the lever cut-out. In some embodiments, the release lever 342 extending from the head 322 parallel or approximately parallel to the flexible body 324 may allow a user to depress the release lever 342 with a single hand while gripping a bar cover. This may increase the ease of removal of the bar cover.

In some embodiments, the release lever 342 may be connected to the head with a connection post 351. The release lever 342 pivots about the connection post 351 to move between the open position and the closed position. When a worker depresses the release lever 342, the release lever 342 may pivot about the connection post 351 to move the release lever 342 and the ratcheting mechanism into an open position such that the flexible body 324 may be removed from the head 322.

In some embodiments, the release lever 342 and the ratcheting mechanism may be urged into the closed position. For example, a user may apply a release force to the release lever 342 to move the release lever 342 and the ratcheting mechanism into the open position. When the release force is removed from the release lever 342, the release lever 342 and the ratcheting mechanism may be urged back to the closed position. In some embodiments, the connection post 351 may urge the release lever 342 and the ratcheting mechanism back to the close position. For example, the connection post 351, the head 322, and the release lever 342 may be integrally formed (e.g., formed without any joints, seams, adhesives, fasteners). The connection post 351 may be formed from an elastically deformable material. The non-deformed position of the connection post 351 may be to place the release lever 342 and the ratcheting mechanism in the closed position. Thus, when the release lever 342 is moved into the open position, and the release force is removed, the material properties of the connection post 351 may cause the release lever 342 and the ratcheting mechanism to move back to the closed position. In some embodiments, the connection post 351 and/or the head 322 may include a resilient member, such as a spring, that urges the release lever 342 and the ratcheting mechanism into the closed position. In some embodiments, the connection post 351 may be separately formed from the head 322 and/or the release lever 342, and the release lever 342 may be urged back to the closed position using a resilient member.

Figure 4:
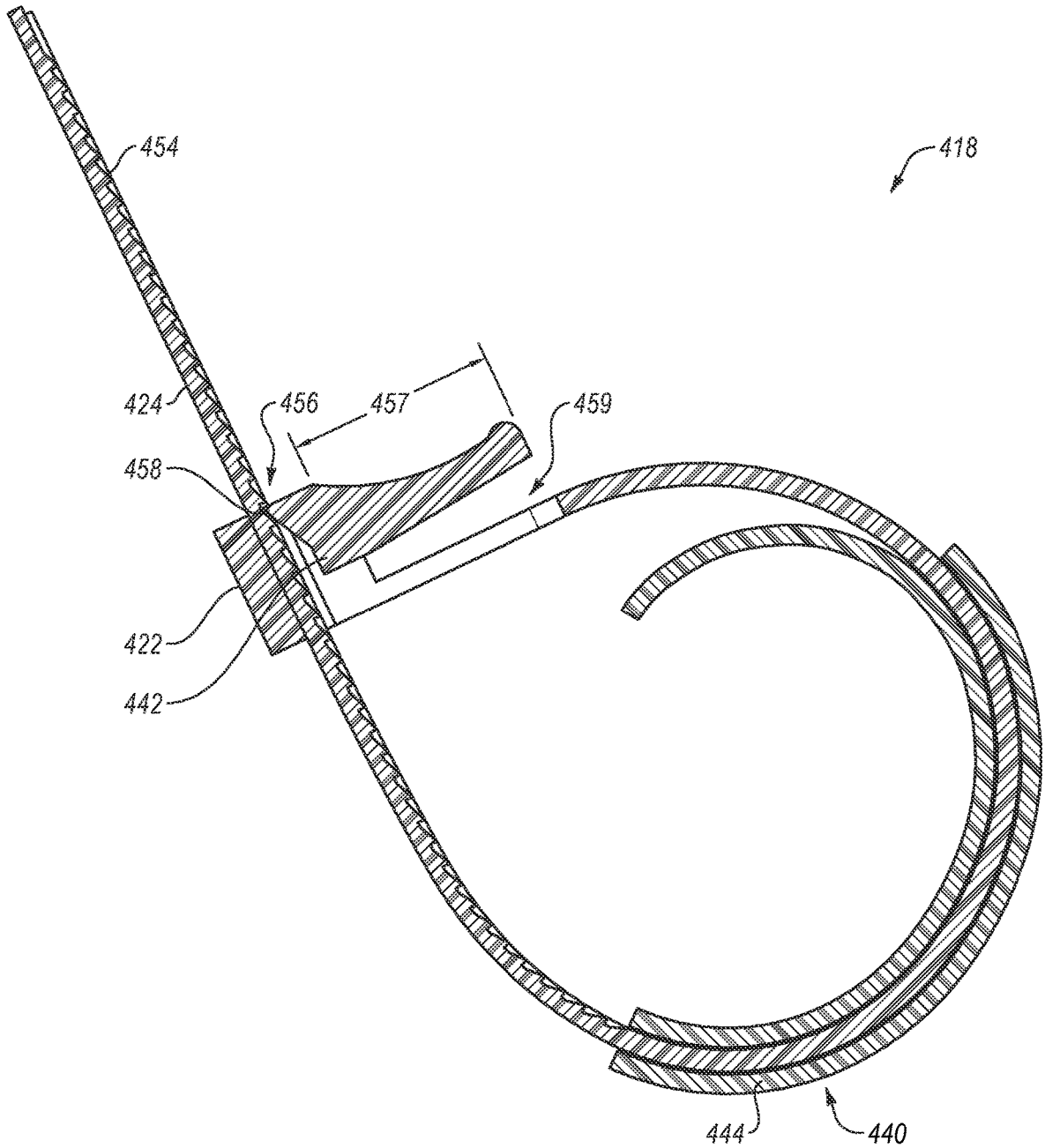
FIG. 4 is a representation of a cross-sectional view of a bar tie in a looped position, according to at least one embodiment of the present disclosure.

FIG. 4 is a representation of a cross-sectional view of a looped bar tie 418, according to at least one embodiment of the present disclosure. The bar tie 418 shown includes a flexible body 424 inserted into a head 422. The head 422 may be integrally formed with the flexible body 424. Put another way, the head 422 may be formed out of the same material as the flexible body 424 without any joins or other connections between the head 422 and the flexible body 424. As may be seen, the high friction coating 444 is located on a looped portion 440 of the flexible body 424.

The head 422 includes a ratcheting mechanism 456. The ratcheting mechanism 456 may include a wedge 458. The wedge 458 may be inserted into a valley between two ridges 454 on the underside of the flexible body 424. The ridges 454 may be shaped with a sloped surface. As the flexible body 424 is pulled through the head 422, the sloped surface may push the wedge 458 outward until the wedge 458 moves past the ridge 454 to the next valley between ridges 454. Each ridge 454 may include a vertical surface. When in the valley between two ridges 454, the vertical surface may contact the wedge 458. The contact between the vertical surface and the wedge 458 may prevent the flexible body 424 from being removed through the head 422.

The ratcheting mechanism 456 may include a release lever 442. The release lever 442 may be connected to the wedge 458. The release lever 442 may be rotatably connected to the head 422. When the release lever 442 is rotated relative to the head 422, the release lever 442 may move the wedge 458 out from between two ridges 454. Moving the wedge 458 from between the two ridges 454 may prevent the vertical surface from contacting the wedge 458. This may allow the flexible body 424 to be removed from the head 422. Thus, the bar tie 418 may be selectively released from the rebar. Thus, the releasable bar tie 418 may allow a rebar cap to be reusable many times, thereby saving time and money replacing broken rebar caps.

The release lever 442 includes a lever length 457. The lever length 457 may be the length of the release lever 442 from the wedge 458 to an end of the release lever 442. In some embodiments, the lever length 457 may be in a range having an upper value, a lower value, or upper and lower values including any of 0.1 in. (2.5 mm), 0.2 in. (5.1 mm), 0.3 in. (7.6 mm), 0.4 in. (1.0 cm), 0.5 in. (1.3 cm), 0.6 in. (1.5 cm), 0.7 in. (1.8 cm), 0.8 in. (2.0 cm), 0.9 in. (2.3 cm), 1.0 in. (2.5 cm), 1.5 in. (3.8 cm), 2.0 in. (5.1 cm), 3 in. (7.6 cm), 4 in. (10.2 cm), or any value therebetween. For example, the lever length 457 may be greater than 0.1 in. (2.5 mm). In another example, the lever length 457 may be less than 4 in. (10.2 cm). In yet other examples, the lever length 457 may be any value in a range between 0.1 in. (2.5 mm) and 4 in. (10.2 cm). In some embodiments, it may be critical that the lever length 457 is greater than 0.5 in (1.3 cm) to allow a worker to feel and depress the release lever 442 while wearing gloves, such as work gloves. Work gloves may provide protection to a worker's hands during construction tasks. Indeed, work gloves are required to be worn at all times at may construction and other job sites. Depressing the release lever 442 while wearing work gloves may allow a worker to install, remove, and replace rebar covers while complying with any applicable safety standards.

In the embodiment shown, the head 422 includes a lever cut-out 459. The lever cut-out 459 may be a space in the head 422 that allows the release lever 442 to be depressed further. This may help to ensure that a worker may depress the release lever 442 sufficiently to move the wedge 458 out of the valley between two ridges 454.

In the embodiment shown, the ratcheting mechanism 456 utilizes a wedge 458 and a plurality of ridges 454. However, it should be understood that the ratcheting mechanism 456 may include any other type of ratcheting mechanism. For example, the ratcheting mechanism may include a cam having a high friction surface. The cam may be rotatable relative to the head 422. The cam may rotate into the flexible body 424, causing the high friction surface to bite into the flexible body 424 to prevent the flexible body 424 from being removed from the head 422. The cam may be released by depressing a release lever connected to the cam. In some embodiments, the head 422 may have an opening that is the same size as or slightly smaller than the outside perimeter of the flexible body 424. The flexible body 424 may pass through the opening and be retained based on a friction interface between the flexible body 424 and the opening. In some embodiments, the flexible body 424 may have a generally cylindrical body (e.g., the flexible body 424 may have a generally circular or ovoid cross sectional shape), and the head 422 may include a flexible port for the flexible body 424 to travel through. In some embodiments, the head 422 may include a lever, latch, strap, or other element that a user may apply to the flexible body 424 to secure the flexible body to the head 422.

In some embodiments, the ratcheting mechanism 456 may include any other type of mechanism. For example, the ratcheting mechanism 456 may include a pipe clamp. A pipe clamp may include a flexible body having a plurality of slots and a worm gear or screw connected to the head. Rotating the worm gear (such as with a screw driver, a wing nut, a knob, or other mechanism) may move the flexible body through the head. In some examples, the ratcheting mechanism 456 may include a flexible body having radial protrusions that extend the diameter. The head may include a hole that is smaller than the radial protrusions such that the radial protrusion are pulled through and elastically compressed to fit through the head. In some examples, the ratcheting mechanism may include a tie. The tie may include two free ends that are inserted into the body of the rebar cap. The two free ends may be rotated around each other to tighten the tie and secure the piece of rebar to the rebar cover. In some embodiments, the ratcheting mechanism 456 may include any combination of ratcheting mechanisms discussed herein.

Figure 5:
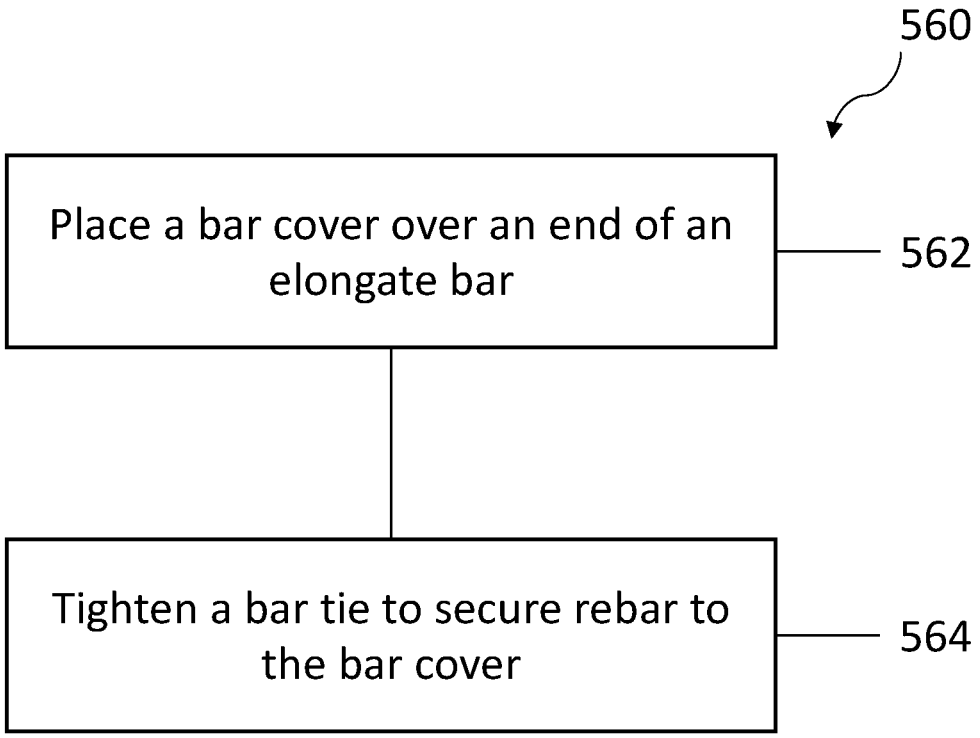
FIG. 5 is a representation of a method for securing an end of an elongate bar, according to at least one embodiment of the present disclosure.

FIG. 5 is a representation of a method 560 for securing an end of an elongate bar, according to at least one embodiment of the present disclosure. The method 560 may be implemented using the rebar cover assembly 101 of FIG. 1. The method 560 includes placing a bar cover over an end of an elongate bar at 562. The elongate bar may be inserted into a central bore of a shaft. In some embodiments, the elongate bar may be inserted through a looped portion of a bar tie that is inserted into the central bore of the shaft.

The method 560 may further include tightening the bar tie to secure the rebar to the bar cover at 564. In some embodiments, tightening the bar tie may include pulling the bar tie in a first direction. A ratcheting mechanism in the bar tie may help to prevent the bar tie from being loosened.

Figure 6:
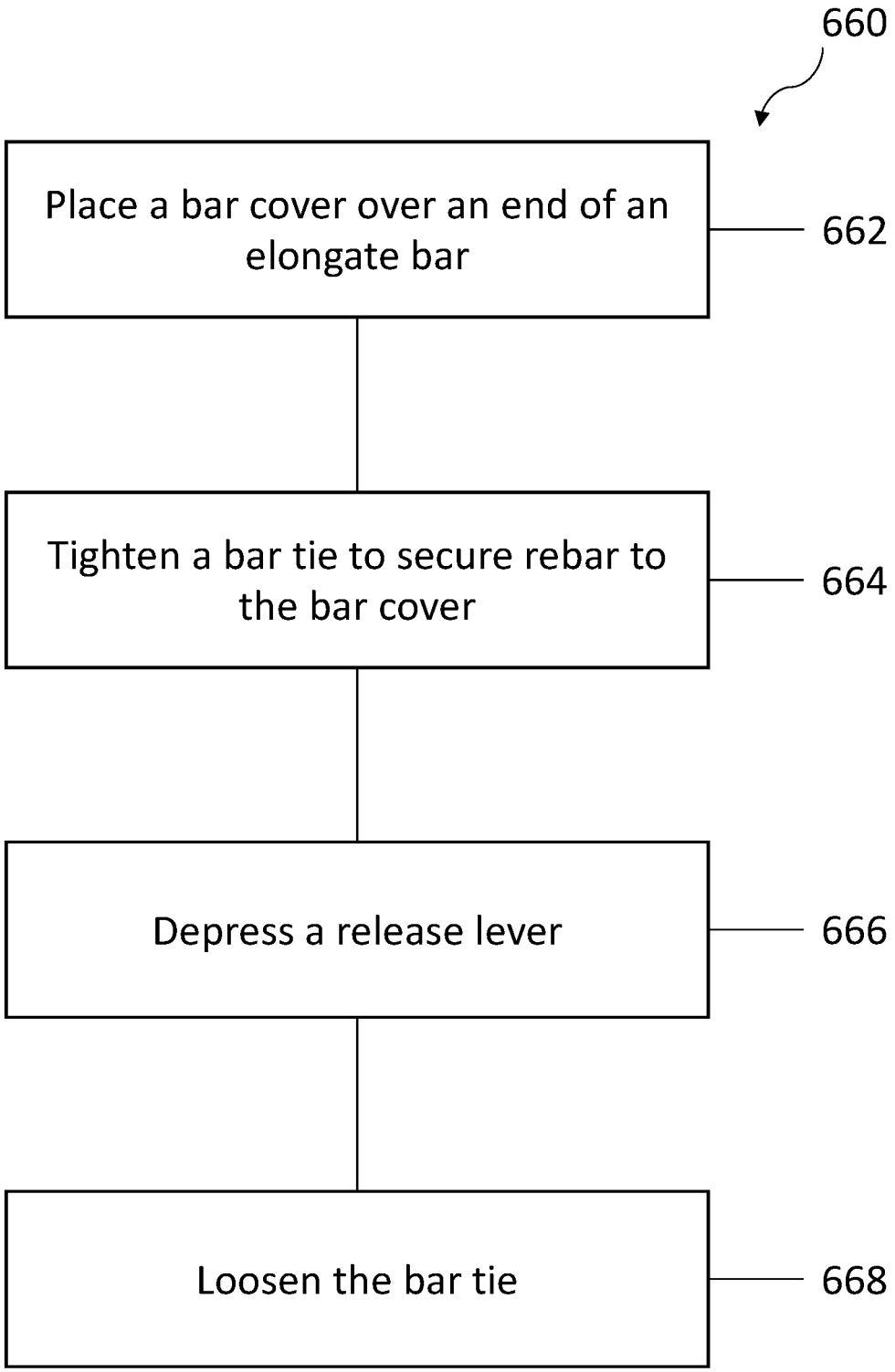
FIG. 6 is a representation of another method for securing an end of an elongate bar, according to at least one embodiment of the present disclosure.

FIG. 6 is a representation of a method 660 for securing an end of an elongate bar, according to at least one embodiment of the present disclosure. The method 660 may be implemented using the rebar cover assembly 101 of FIG. 1. The method 660 includes placing a bar cover over an end of an elongate bar at 662. The elongate bar may be inserted into a central bore of a shaft. In some embodiments, the elongate bar may be inserted through a looped portion of a bar tie that is inserted into the central bore of the shaft.

The method 660 may further include tightening the bar tie to secure the rebar to the bar cover at 664. In some embodiments, tightening the bar tie may include pulling the bar tie in a first direction. A ratcheting mechanism in the bar tie may help to prevent the bar tie from being loosened.

To remove the bar cover, a release lever connected to the ratcheting mechanism may be depressed at 666. The release lever may move the ratcheting mechanism into an open position. In the open position, the flexible body may be moved in the second direction. This may allow the bar tie to be loosened at 668. After the bar tie is loosened, the bar cover may be removed from the end of the rebar.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A device to cover an end of an elongate bar, comprising:
a shaft, including:
a first end;
a second end opposite the first end across the shaft, wherein a central bore extends between the first end and the second end, the elongate bar being configured to be inserted into the central bore; and
a sidewall, the shaft including a first opening and a second opening through the sidewall into the central bore, the first opening and the second opening being separated by a tie support;
a cover plate covering the first end of the shaft; and
a bar tie at least partially located in the central bore, including:
a head including a ratcheting mechanism, wherein the head is located outside of the central bore; and
a flexible body extending into the central bore through the first opening and out of the central bore through the second opening to form a looped portion in the central bore, the bar tie securing the elongate bar to the shaft based on a compressive force applied to the tie support by the looped portion, the flexible body being movable in the head in a first direction, wherein the ratcheting mechanism prevents the flexible body from being removed from the head in a second direction, opposite the first direction.

2. The device of claim 1, further comprising a high friction coating on the flexible body.

3. The device of claim 2, wherein the high friction coating is formed from silicone.

4. The device of claim 2, wherein the high friction coating includes a sleeve through which at least a portion of the flexible body is inserted.

5. The device of claim 2, wherein the high friction coating is located on a portion of the flexible body located in the central bore.

6. The device of claim 1, wherein the ratcheting mechanism prevents the flexible body from being removed from the head without plastic deforming or fracturing at least one of the flexible body, the head, or the ratcheting mechanism.

7. The device of claim 1, wherein the flexible body is configured to secure the shaft to the end of the elongate bar within the central bore.

8. The device of claim 1, wherein the central bore does not include any securing structures.

9. A device to cover an end of an elongate bar, comprising:
a shaft, including:
a top end;
a bottom end opposite the top end across the shaft, wherein a central bore extends between the top end and the bottom end, the elongate bar being configured to be inserted into the central bore;
a cover plate covering the top end of the shaft;
a bar tie at least partially located in the central bore, including:
a head including a ratcheting mechanism including an open position and a closed position, wherein the head is located outside of the central bore;
a flexible body extending into the central bore, the flexible body being movable in the head in a first direction, wherein, in the closed position, the ratcheting mechanism prevents the flexible body from being removed from the head in a second direction, opposite the first direction; and
a release lever, wherein, when depressed toward the flexible body, the release lever opens the ratcheting mechanism to allow the flexible body to be removed from the head in the second direction.

10. The device of claim 9, wherein the release lever is 0.5 in. (1.27 cm) long.

11. The device of claim 9, wherein the release lever is connected to the head.

12. The device of claim 9, wherein the ratcheting mechanism includes a wedge and the flexible body includes a plurality of ridges, and wherein, when the wedge is inserted in between two ridges of the plurality of ridges, a contact between the wedge and the two ridges of the plurality of ridges prevents the flexible body from being removed from the head in the second direction.

13. The device of claim 12, wherein the release lever is integrally formed with the wedge.

14. The device of claim 13, wherein the release lever is connected to the head with a connection post, and wherein the release lever pivots about the connection post to move between the open position and the closed position.

15. The device of claim 9, wherein the bar tie is removable from the shaft.

16. The device of claim 9, wherein the shaft further includes a sidewall, the shaft including a first opening and a second opening through the sidewall into the central bore, and wherein the flexible body extends into the central bore through the first opening and out of the central bore through the second opening.

17. A method for securing an end of an elongate bar, comprising:
placing a bar cover over the end of the elongate bar, wherein the end of the elongate bar is inserted into a central bore of a shaft of the bar cover, and wherein, when inserted into the central bore of the shaft, a flexible body of a bar tie at least partially surrounds the elongate bar with a looped portion, the flexible body being inserted into the central bore through a first opening in the shaft and out of the central bore through a second opening in the shaft to form the looped portion; and
tightening the bar tie by pulling an insertion end of the flexible body through a head of the bar tie in a first direction, wherein a ratcheting mechanism prevents movement of the bar tie in the head in a second direction, opposite the first direction, and wherein tightening the bar tie includes securing the end of the elongate bar to the bar cover within the central bore of the shaft by reducing a circumference of the looped portion.

18. The method of claim 17, further comprising:
depressing a release lever connected to the head, the lever being configured to place the ratcheting mechanism into an open position; and
loosening the bar tie by moving the flexible body through the head in the second direction when the ratcheting mechanism is placed in the open position.

19. The method of claim 17, further comprising gripping the elongate bar with a high friction coating on the flexible body of the bar tie to increase a removal force of the bar cover.

20. The method of claim 17, wherein, when tightened, a looped portion of the bar tie is located within the central bore of the shaft.

* * * * *